US008126175B2

(12) United States Patent
Tateno et al.

(10) Patent No.: US 8,126,175 B2
(45) Date of Patent: Feb. 28, 2012

(54) HEARING AID DEVICE

(75) Inventors: Makoto Tateno, Tokyo (JP); Takatoshi Okuno, Tokyo (JP); Katsumi Tanaka, Tokyo (JP)

(73) Assignee: Rion Co., Ltd, Tokyo (JP)

( * ) Notice: Subject to any disclaimer, the term of this patent is extended or adjusted under 35 U.S.C. 154(b) by 1263 days.

(21) Appl. No.: 11/762,785

(22) Filed: Jun. 14, 2007

(65) Prior Publication Data

US 2007/0291969 A1 Dec. 20, 2007

(30) Foreign Application Priority Data

Jun. 16, 2006 (JP) ..... 2006-166761

(51) Int. Cl.
*H04R 25/00* (2006.01)

(52) U.S. Cl. ..... 381/315; 381/312

(58) Field of Classification Search ..... 381/312, 381/314, 315

See application file for complete search history.

(56) References Cited

U.S. PATENT DOCUMENTS

2006/0018496 A1* 1/2006 Niederdrank et al. ..... 381/312

FOREIGN PATENT DOCUMENTS

JP 2004-535082 A 4/2002

* cited by examiner

*Primary Examiner* — Brian Ensey
(74) *Attorney, Agent, or Firm* — Lee Fredric Sharra

(57) ABSTRACT

A hearing aid device is provided in which wireless data transmission and reception are established between a first hearing aid and a second hearing aid, worn one on each ear, wherein in a case where wireless transmission and reception are not possible, the first hearing aid and the second hearing aid are switched from a liaison operation mode in which both hearing aids are interactively adjusted to a solo operation mode in which each hearing aid is independently adjusted. In a case where wireless transmission and reception are possible, the first hearing aid and the second hearing aid are switched from the solo operation mode to the liaison operation mode.

12 Claims, 4 Drawing Sheets

HEARING AID DEVICE

BACKGROUND OF THE INVENTION

1. Field of the Invention

The present invention relates to a hearing aid device in which wireless data transmission and reception can be established between a first hearing aid and a second hearing aid, a single hearing aid worn on each ear.

2. Description of the Prior Art

Use of binaural hearing aids, that is, wearing a single hearing aid on each ear, is effective in the discrimination of a sound, identification of the direction of a sound source and the like to many users. In this case, by establishing wireless communication between the two hearing aids, it is possible to carry out an advanced signal processing in which the balance of an automatic gain controller can be maintained. In order to match a signal processor even in the different hearing conditions, a hearing aid system whereby a sound field characteristic value such as a signal level and a frequency spectrum in a sound signal of a sound field is transmitted between the hearing aids, is disclosed (e.g., Patent Document 1).

[Patent Document 1] Japanese Patent Application National Publication No. 2004-535082

However, even in the hearing aids programmed to be worn, one on each ear, if only one of the two hearing aids is utilized due to failure, loss, or exceptional circumstances, there is a problem in that the second hearing aid does not function properly or its performance is limited.

SUMMARY OF THE INVENTION

It is therefore an object of the present invention to provide an improved hearing aid device which can solve the problems stated above and in which, even in the case where wireless transmission and reception are not possible, each hearing aid can perform its necessary performance.

In order to attain this object, according to the first aspect of the present invention, there is provided a hearing aid device in which wireless data transmission and reception are established between a first hearing aid and a second hearing aid, one worn on each ear, wherein in a case where wireless transmission and reception are not possible, the first hearing aid and the second hearing aid are switched from a liaison operation mode in which both hearing aids are interactively adjusted to a solo operation mode in which each hearing aid is independently adjusted.

According to the second aspect of the present invention, in the hearing aid device of the first aspect, in a case where wireless transmission and reception are possible, the first hearing aid and the second hearing aid are switched from the solo operation mode to the liaison operation mode.

According to the third aspect of the present invention, in the hearing aid device of the first aspect or the second aspect, when one of the first hearing aid and the second hearing aid is operated to control the sound volume, the other is also interactively caused to control the volume.

According to the fourth aspect of the present invention, in the hearing aid device of the first aspect or the second aspect, when the first hearing aid is operated to control the volume, the second hearing aid is also interactively caused to control the volume, and when the second hearing aid is operated to control the volume, only the second hearing aid is independently caused to control the volume.

According to the fifth aspect of the present invention, in the hearing aid device of the third aspect, a loudness memory means for storing loudness change characteristics of carrying hearing ability of a user to the change of volume is provided, and when the first hearing aid and the second hearing aid are interactively caused to control the volume, the loudness conformity or the loudness difference of both ears of a user are made constant.

According to the sixth aspect of the present invention, in the hearing aid device of the first aspect, a means for automatically adjusting amplifying characteristics and/or frequency response characteristics in response to the ambient sound conditions is provided, and the first hearing aid and the second hearing aid are automatically adjusted in unison by using wireless transmission and reception.

According to the seventh aspect of the present invention, in the hearing aid device of the first aspect, a means for analyzing and/or classifying the ambient sound conditions to automatically adjust the amplifying characteristics is provided, and the results of analysis and/or classification of the first hearing aid and the second hearing aid are caused to conform by using wireless transmission and reception.

According to the eighth aspect of the present invention, in the hearing aid device of the first aspect or the second aspect, when one of the first hearing aid and the second hearing aid is operated to select a program, the other is also interactively caused to select the program.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

Figure 1:
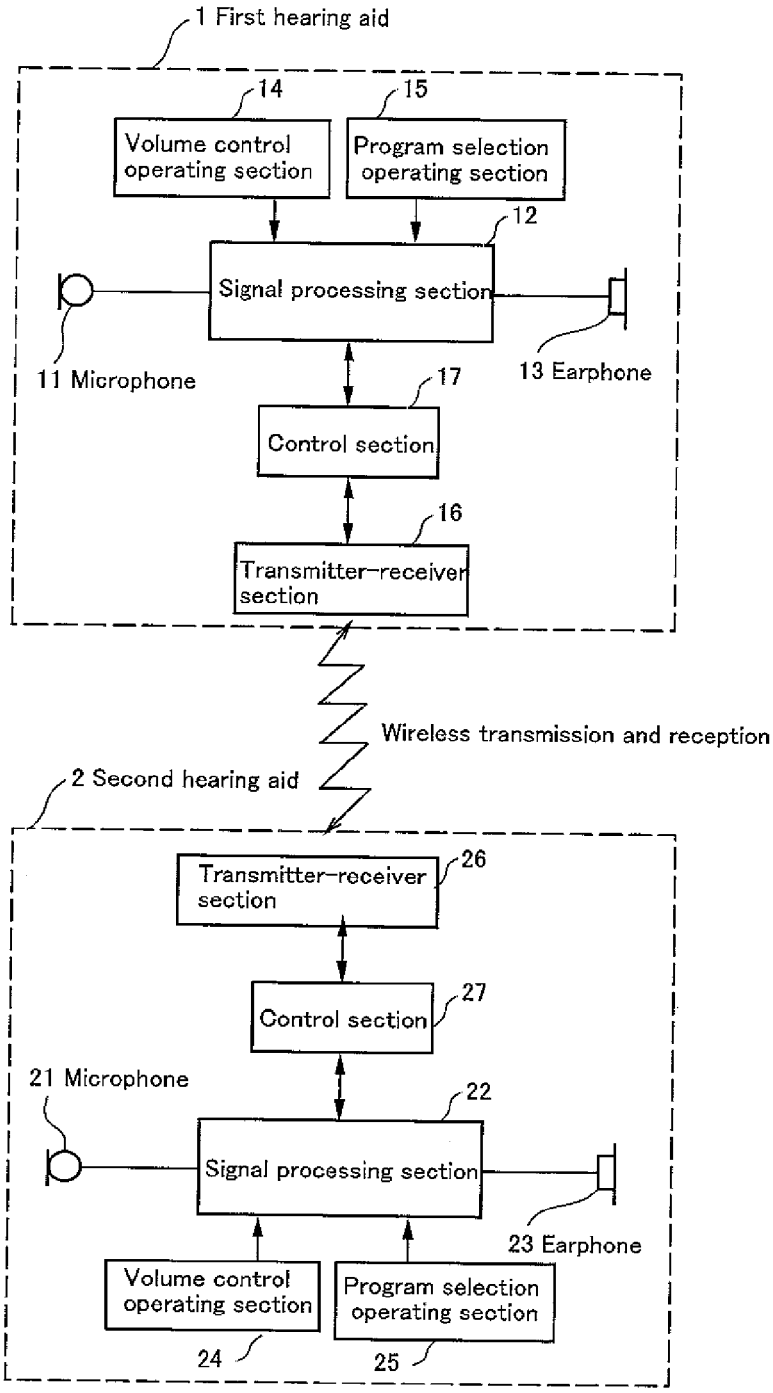
FIG. 1 is a block diagram of a hearing aid device according to the present invention.
Figure 2:
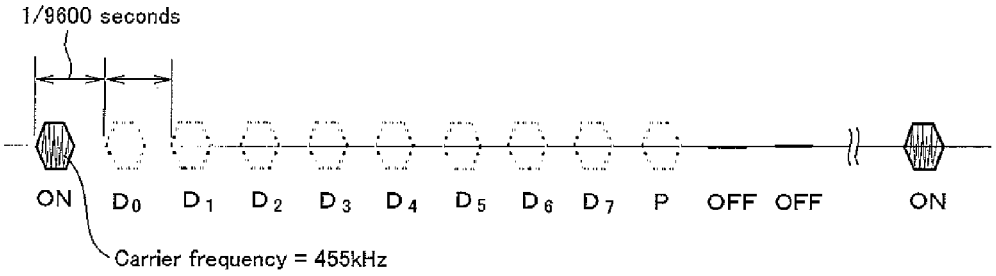
FIG. 2 is a view showing a signal pattern of the wireless transmission and reception.
Figure 3:
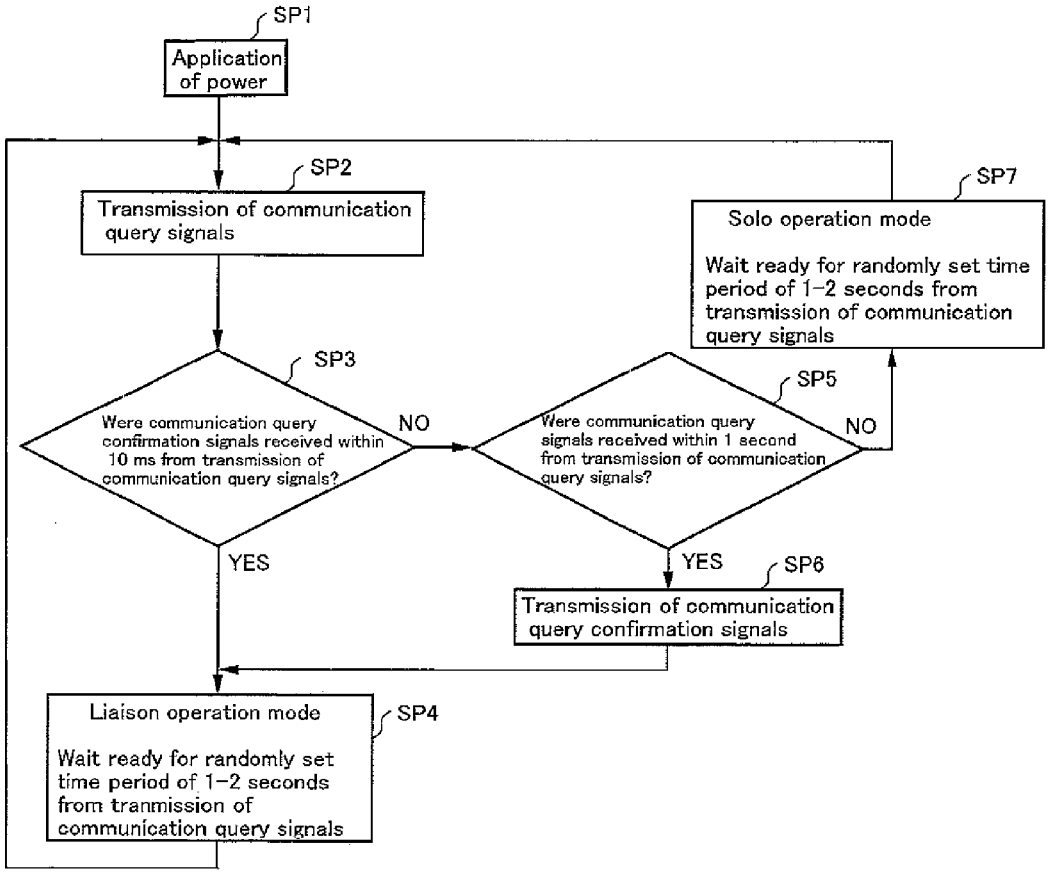
FIG. 3 is a flow chart of communication check in the wireless transmission and reception.
Figure 4:
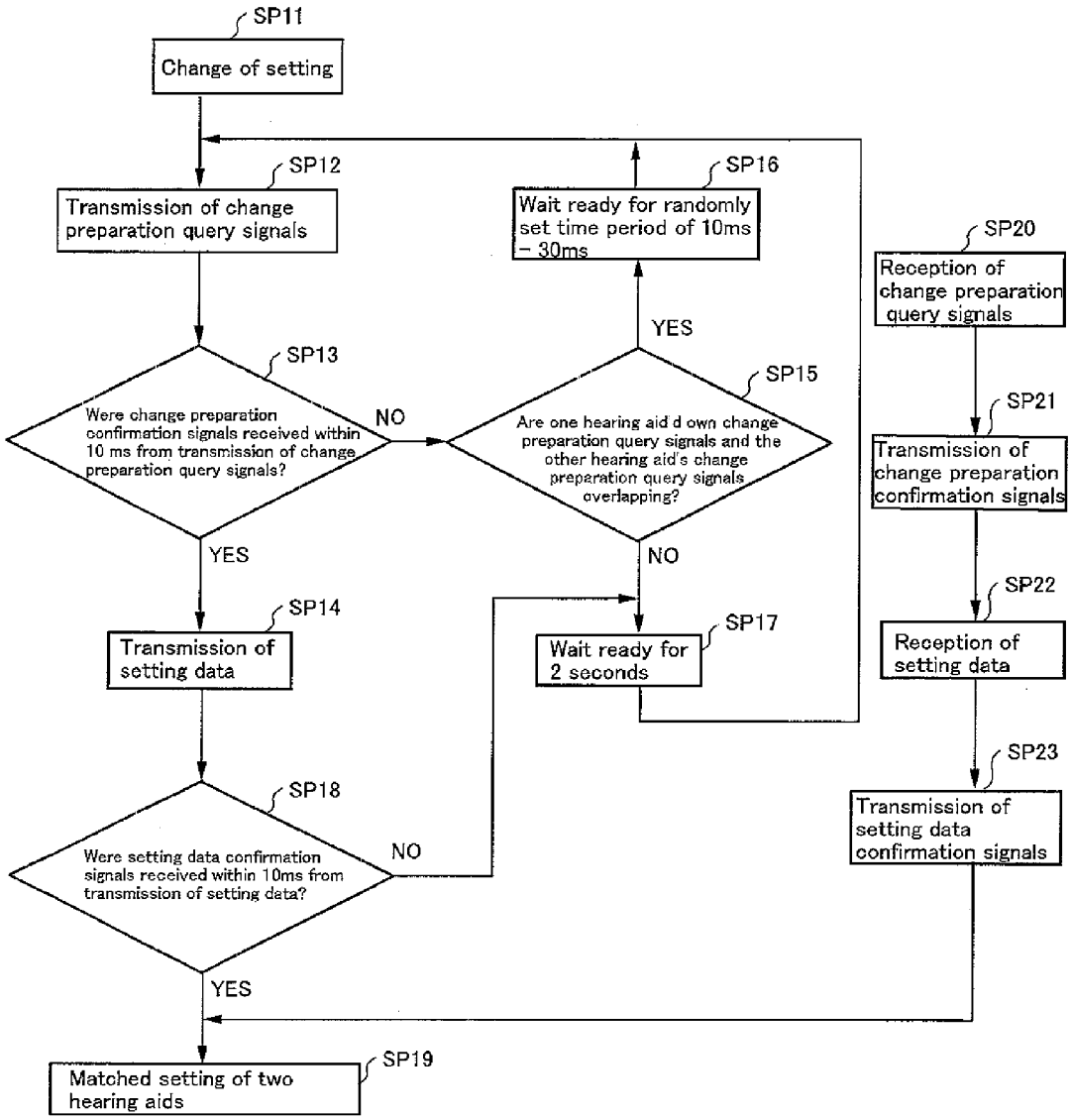
FIG. 4 is a flow chart of a liaison operation mode.
Figure 5:
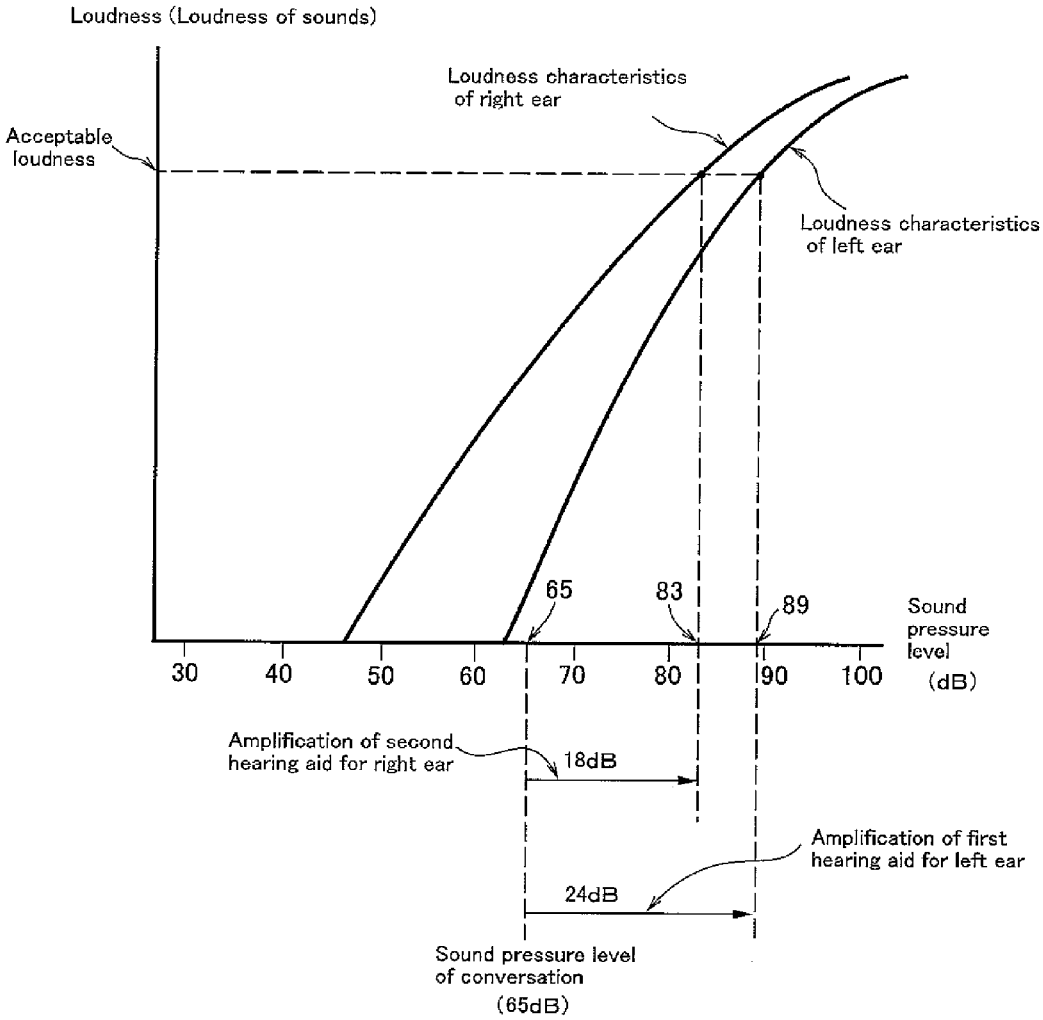
FIG. 5 is an explanatory view of an interactive volume control method with loudness change characteristics in mind.

A preferred embodiment of the present invention will now be described with reference to the accompanying drawings. FIG. 1 is a block diagram of a hearing aid device according to the present invention. FIG. 2 is a view showing a signal pattern of wireless transmission and reception. FIG. 3 is a flow chart of the communication check in wireless transmission and reception, FIG. 4 is a flow chart of a liaison operation mode, and FIG. 5 is an explanatory view of an interactive volume control method with loudness change characteristics in mind.

A hearing aid device according to the present invention comprises, as shown in FIG. 1, a first hearing aid 1 for a left ear and a second hearing aid 2 for a right ear. There is no relationship of principal and accessory between the first hearing aid 1 and the second hearing aid 2, but these two hearing aids have an equal relationship.

The first hearing aid 1 comprises a microphone 11, a signal processing section 12, an earphone 13, a volume control operating section (volume) 14, a program selection operating section (switch) 15, a transmitter-receiver section 16, and a control section 17. The second hearing aid 2 has the same structure as the first hearing aid 1 and comprises a microphone 21, a signal processing section 22, an earphone 23, a volume control operating section (volume) 24, a program selection operating section (switch) 25, a transmitter-receiver section 26, and a control section 27. The signal processing sections 12, 22 and the control sections 17, 27 are composed of an integral processor. Further, the signal processing sections 12, 22 are provided with a loudness memory means and an automatic adjusting means, respectively.

The microphones 11, 21 convert audio signals to electrical signals and output the converted electrical signals. The signal processing sections 12, 22 apply various kinds of signal processing to the electrical signals output by the microphones 11, 21 and output electrical signals to which signal processing has been applied. The earphones 12, 23 convert the output signals of the signal processing sections 12, 22 to sound signals and output audio signals. The volume control operating sections (volume) 14, 24 and the program selection operating sections (switch) 15, 25 are operated by a user. The transmitter-receiver sections 16, 26 are provided to establish wireless transmission and reception between the first hearing aid 1 and the second hearing aid 2. The control sections 17, 27 are provided to control wireless transmission and reception.

Communication between the first hearing aid 1 and the second hearing aid 2 is established by the transmitter-receiver section 16 and the control section 17 of the first hearing aid 1 and the transmitter-receiver section 26 and the control section 27 of the second hearing aid 2, wherein electromagnetic waves of a pattern as shown in FIG. 2 are used. In transmitting a communication, burst waves of a carrier frequency are emitted from the transmitter-receiver sections 16, 26 with a frequency of 9600 bps. The carrier frequency is, for example, 455 k Hz. One unit of transmission is 12 bits, wherein the burst signals are emitted when each bit is ON, and the burst signals are not emitted when each bit is OFF.

The first bit is always ON, and data bits (D0-D7) of eight ON or OFF bits follow. Then, an even parity bit (P) and two OFF bits of the data bits are designed to follow. The data to be transmitted includes communication check data, reception confirmation data, error response data, volume control data, program selection data and the like depending on the configuration of the data bits (D0-D7).

Operation of the hearing aid device as configured above according to the present invention will now be described. First, the communication check (refer to FIG. 3) is conducted as follows. Power is applied to the first hearing aid 1 and the second hearing aid 2, respectively (SP1). Then, the first hearing aid 1 and the second hearing aid 2 transmit the communication check data (i.e., communication query signal) to one another at the time of application of power and every second thereafter (SP2). Next, it is judged whether or not one hearing aid received the reception confirmation data (i.e., communication query confirmation signals) from the other hearing aid, to which the communication check data was transmitted, within 10 ms from the transmission of the communication check data (SP3).

In SP3, if it is judged that one hearing aid received the reception confirmation data within 10 ms from the transmission of the communication check data, both hearing aids proceed to a liaison operation mode and wait ready only for a randomly set time period of 1-2 seconds from the transmission of the communication check data while conducting required operations (SP4) and then, a program returns to SP2. On the other hand, in SP3, if it is judged that one hearing aid has not received the reception confirmation data within 10 ms from the transmission of the communication check data, it is judged again whether or not one hearing aid received the communication check data (i.e., communication query signals) from the other hearing aid within 1 second from the transmission of the communication check data (SP5).

In SP5, if it is judged that one hearing aid received the communication check data from the other hearing aid within 1 second from the transmission of the communication check data, the reception confirmation data (i.e., communication query confirmation signals) are transmitted to the other hearing aid (SP6), and the program proceeds to SP4. On the other hand, in SP5, if it is judged that one hearing aid has not received the communication check data from the other hearing aid within 1 second from the transmission of the communication check data, it is decided that the other hearing aid has not been worn, one hearing aid proceeds to a solo operation mode and waits ready only for a randomly set time period of 1-2 seconds from the transmission of the communication check data while conducting required operations (SP7).

Even after this, the program returns to SP2, and one hearing aid continues to transmit the communication check data to the other hearing aid every 1-2 seconds. It is to be noted that the communication check (refer to FIG. 3) is always carried out between the first hearing aid and the second hearing aid regardless of the solo operation mode or the liaison operation mode. In the case where the wireless communication is recovered, both hearing aids immediately return to the liaison operation mode from the solo operation mode.

Next, the setting change (refer to FIG. 4) in the liaison operation mode is carried out as follows. For example, in the case where a setting change occurs where a user carries out the volume control operation and the like of the first hearing aid or the second hearing aid (SP11), one hearing aid transmits the change preparation query signals to the other hearing aid (SP12). Then, it is judged whether or not one hearing aid received the change preparation confirmation signals from the other hearing aid, to which the change preparation query signals were transmitted, within 10 ms from the transmission of the change preparation query signals (SP13). In SP13, if it is judged that one hearing aid received the change preparation confirmation signals, the setting data (i.e., volume control data) is transmitted to the other hearing aid (SP14).

On the other hand, in SP13, if it is judged that one hearing aid has not received the change preparation confirmation signals, it is judged whether or not one hearing aid's own change preparation query signals and the other hearing aid's change preparation query signals overlap (SP15). In SP15, if it is judged that both the change preparation query signals overlap, the program returns to SP12 after randomly set time intervals of 10-30 ms (SP16), and the change preparation query signals are transmitted again to the other hearing aid. On the other hand, in SP15, if it is judged that the change preparation query signals do not overlap, the program returns to SP12 after waiting for 2 seconds (SP17).

In SP18 after SP14 in which the setting data is transmitted, it is judged whether or not one hearing aid received the setting data confirmation signals from the other hearing aid within 10 ms after transmitting the setting data to the other hearing aid (SP18). In SP18, if it is judged that one hearing aid received the setting data confirmation signals, the setting data (volume control) matched with the first hearing aid and the second hearing aid is set (SP19). On the other hand, in SP18, if it is judged that one hearing aid has not received the setting data confirmation signals, the program proceeds to SP17.

Further, in the case where the change preparation query signals were transmitted from the other hearing aid, one hearing aid receives the change preparation query signals (SP20) and then transmits the change preparation confirmation signals to the other hearing aid (SP21). Still further, one hearing aid receives the setting data transmitted from the other hearing aid (SP22) and then transmits the setting data confirmation signals to the other hearing aid (SP23). Then, the program proceeds to SP19, wherein the setting data (volume control) matched with the first hearing aid and the second hearing aid is set. It is to be noted that the setting change (refer to FIG. 4) in the liaison operation mode can be carried out in the first hearing aid 1 and/or the second hearing aid 2.

Next, in the case where the volume control is carried out in the liaison operation mode, it is possible to store the loudness change characteristics of the user's carrying hearing ability relative to the volume change in the loudness memory means and to make adjustments so that the relationship of the loudness between both ears can be maintained. The loudness change characteristics can be measured when fitting of the hearing aid is carried out or can be statistically estimated based on the auditory capacity of the user.

One example of a volume control method with the loudness change characteristics in mind is shown in FIG. 5. In many cases, the loudness change varies between the right and left ears. The intensity of sound (i.e., sound pressure level) corresponding to the loudness which is acceptable to the user is 89 dB for the left ear and 83 dB for the right ear in this example. If the sound pressure level of a conversation is 65 dB, the optimum sound gain of the first hearing aid 1 for the left ear is 24 dB, while the optimum sound gain of the second hearing aid 2 for the right ear is 18 dB. In the liaison operation mode, when the user operates the volume control operating section 14 or 24, the sound gain of the hearing aids 1, 2 are caused to change corresponding to the change of sound pressure level while maintaining the relationship as describe above.

Further, when the user selects a desired program using the program selection operating section 15 of the first hearing aid 1, the second hearing aid 2 is also interactively caused to select the same program as the first hearing aid 1. Likewise, when the user selects a desired program using the program selection operating section 25 of the second hearing aid 2, the first hearing aid 1 is also interactively caused to select the same program as the second hearing aid 2.

Still further, when the user operates the volume control operating section 14 of the first hearing aid 1 to control the volume, the second hearing aid 2 is also interactively caused to control the volume. However, even though the user operates the volume control operating section 24 of the second hearing aid 2 to control the volume, programming can be made in such a manner that the first hearing aid 1 does not interact with the second hearing aid 2 to control the volume, but only the second hearing aid 2 is independently caused to control the volume. It is therefore possible to respond even in the case where the user intends to change the balance of volume between the right and left hearing aids.

Effects of the Invention

According to the first aspect of the present invention, each hearing aid can be independently adjusted even in the case where wireless transmission and reception are not possible. It is therefore possible to control the volume and the like suitable for a user and to display the desired performance.

According to the second aspect, the first hearing aid and the second hearing aid are switched from a solo operation mode to a liaison operation mode in the case where wireless transmission and reception are possible. It is therefore possible to automatically adjust the first hearing aid and the second hearing aid in unison by using wireless transmission and reception and to adjust both hearing aids in the optimum condition for the user wearing the binaural hearing aids.

According to the third aspect, it is possible to smoothly carry out the volume control of the first hearing aid and the second hearing aid and as a result, usability for the user wearing the binaural hearing aids improves.

According to the fourth aspect, when the first hearing aid is operated to control the volume, the second hearing aid is also interactively caused to control the volume. However, even though the second hearing aid is operated to control the volume, only the second hearing aid is independently caused to control the volume. It is therefore possible to respond even to the case where the user intends to change the balance of volume between the right and left hearing aids.

According to the fifth aspect, adjustments are made to store the loudness change characteristics of user's carrying hearing ability to the change of volume and to maintain the relationship of the loudness between the user's right and left ears when the first hearing aid and the second hearing aid are interactively caused to control the volume. It is therefore possible to establish an optimum sound gain for the user wearing the binaural hearing aids.

According to the sixth aspect, a means for automatically adjusting the amplification characteristics and/or the frequency response characteristics in response to the ambient sound conditions is provided. Accordingly, even in the case where there is a difference in the volume input to the right and left hearing aids because a sound source is near one of two hearing aids, the first hearing aid and the second hearing aid are automatically adjusted in unison by using wireless transmission and reception and thus, both hearing aids can be adjusted in an optimum condition for the user wearing the binaural hearing aids.

According to the seventh aspect, a means for analyzing and/or classifying the ambient sound conditions to automatically adjust the amplification characteristics is provided. It is therefore possible to cause the results of analysis and/or classification of the first and second hearing aids to conform by using wireless transmission and reception and to adjust both hearing aids in an optimum condition for the user wearing the binaural hearing aids.

According to the eighth aspect, usability for the user wearing the binaural hearing aids improves because when one of the first hearing aid and the second hearing aid is operated to select a program, the other is also interactively caused to select the program.

Industrial Applicability

According to the present invention, in the case where wireless transmission and reception are not possible, a first hearing aid (for the left ear) and a second hearing aid (for the right ear) are switched from a liaison operation mode in which both hearing aids are interactively adjusted to a solo operation mode in which each hearing aid is independently adjusted, while in the case where wireless transmission and reception are possible, both hearing aids are switched from the solo operation mode to the liaison operation mode. In this manner, it is possible to provide a hearing aid of which the usability for the user wearing the binaural hearing aids improves and as a result, this contributes to the expansion of demand for the hearing aids.

What is claimed is:

1. A hearing aid device in which wireless data transmission and reception are established between a first hearing aid and a second hearing aid, worn one on each ear, wherein in a case where wireless transmission and reception are not possible, that is reception of the communication query confirmation signals in response to communication query signals is impossible when either of the first or second hearing aid is not working or not being worn, the first hearing aid and the second hearing aid are switched from a liaison operation mode in which both hearing aids are interactively adjusted to a solo operation mode in which each hearing aid is independently adjusted.

2. The hearing aid device according to claim 1, wherein in a case where wireless transmission and reception are possible, that is reception of the communication query confirmation signals in response to communication query signals is possible, the first hearing aid and the second hearing aid are switched from the solo operation mode to the liaison operation mode.

3. The hearing aid device according to claim 1, wherein in a case where wireless transmission and reception are possible, that is reception of the communication query confirmation signals in response to communication query signals is possible, if one of the first hearing aid and the second hearing aid is operated to control the sound volume, the other is also interactively caused to control the volume.

4. The hearing aid device according to claim 1, wherein if the first hearing aid is operated to control the volume, the second hearing aid is also interactively caused to control volume, while if the second hearing aid is operated to control the volume, where wireless transmission and reception are possible, that is reception of the communication query confirmation signals in response to communication query signals is possible, only the second hearing aid is independently caused to control the volume.

5. The hearing aid device according to claim 3, wherein a loudness memory means is provided for storing loudness change characteristics of a user's carrying power relative to the change of volume, and when the first hearing aid and the second hearing aid are interactively caused to control the volume, the loudness conformity or the loudness difference of the user's right and left ears is made constant.

6. The hearing aid device according to claim 1, wherein a means is provided for automatically adjusting amplifying characteristics and/or frequency response characteristics in response to the ambient sound conditions, and the first hearing aid and the second hearing aid are automatically adjusted in unison by using wireless transmission and reception.

7. The hearing aid device according to claim 1, wherein a means is provided for analyzing and/or classifying the ambient sound conditions to automatically adjust the amplifying characteristics, and the results of analysis and/or classification of the first hearing aid and the second hearing aid are caused to conform by using wireless transmission and reception.

8. The hearing aid device according to claim 1, wherein if one of the first hearing aid and the second hearing aid is operated to select a program, the other is also interactively caused to select the program.

9. The hearing aid device according to claim 2, wherein in a case where wireless transmission and reception are possible, that is reception of the communication query confirmation signals in response to communication query signals is possible, if one of the first hearing aid and the second hearing aid is operated to control the sound volume, the other is also interactively caused to control the volume.

10. The hearing aid device according to claim 2, wherein if the first hearing aid is operated to control the volume, the second hearing aid is also interactively caused to control volume, where wireless transmission and reception are possible, that is reception of the communication query confirmation signals in response to communication query signals is possible, while if the second hearing aid is operated to control the volume, only the second hearing aid is independently caused to control the volume.

11. The hearing aid device according to claim 9, wherein a loudness memory means is provided for storing loudness change characteristics of a user's carrying power relative to the change of volume, and when the first hearing aid and the second hearing aid are interactively caused to control the volume, the loudness conformity or the loudness difference of the user's right and left ears is made constant.

12. The hearing aid device according to claim 2, wherein if one of the first hearing aid and the second hearing aid is operated to select a program, the other is also interactively caused to select the program.

* * * * *